US010358752B2

(12) United States Patent
Tsujino

(10) Patent No.: US 10,358,752 B2
(45) **Date of Patent: *Jul. 23, 2019**

(54) SHEET MANUFACTURING APPARATUS

(71) Applicant: SEIKO EPSON CORPORATION, Tokyo (JP)

(72) Inventor: Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

This patent is subject to a terminal disclaimer.

(21) Appl. No.: 15/300,568

(22) PCT Filed: Apr. 13, 2015

(86) PCT No.: PCT/JP2015/002058

§ 371 (c)(1),
(2) Date: Sep. 29, 2016

(87) PCT Pub. No.: WO2015/159531

PCT Pub. Date: Oct. 22, 2015

(65) Prior Publication Data

US 2017/0114484 A1 Apr. 27, 2017

(30) Foreign Application Priority Data

Apr. 14, 2014 (JP) ..... 2014-082553

(51) Int. Cl.
*B27N 3/04* (2006.01)
*D04H 1/736* (2012.01)
(Continued)

(52) U.S. Cl.
CPC ..... *D04H 1/736* (2013.01); *B27N 3/00* (2013.01); *B27N 3/007* (2013.01); *B27N 3/04* (2013.01); *B27N 3/12* (2013.01); *D04H 1/60* (2013.01)

(58) Field of Classification Search
USPC ..... 162/289
See application file for complete search history.

(56) References Cited

U.S. PATENT DOCUMENTS 2,379,163 A 6/1945 Landon
4,309,246 A * 1/1982 Hulit ..... D21H 25/005 162/113

(Continued)

FOREIGN PATENT DOCUMENTS

CN 1106854 A 8/1995
CN 102869822 A 1/2013

(Continued)

OTHER PUBLICATIONS

The Extended European Search Report for the corresponding European Patent Application No. 15779448.8 dated Nov. 7, 2017.

*Primary Examiner* — Mark Halpern

(57) ABSTRACT

A sheet manufacturing apparatus can manufacture sheets using a small amount of energy even when making high grammage sheets.

A sheet manufacturing apparatus according to the invention is characterized by supplying 0.014 times or more and 0.28 times or less energy to heat and compress a laid web of fiber and resin, bond multiple fibers through the resin, and forma sheet with grammage of 80 g/m$^2$ than the energy consumed to dry a web containing approximately the same weight percent of water as fiber and form a sheet with grammage of 80 g/m$^2$.

3 Claims, 1 Drawing Sheet

(51) Int. Cl.

| | |
|---|---|
| ***B27N 3/00*** | (2006.01) |
| ***B27N 3/12*** | (2006.01) |
| ***D04H 1/60*** | (2006.01) |

(56) References Cited

U.S. PATENT DOCUMENTS

| | | | | |
|---|---|---|---|---|
| 5,057,166 | A | 10/1991 | Young, Sr. et al. | |
| 5,064,689 | A | 11/1991 | Young, Sr. et al. | |
| 5,411,636 | A * | 5/1995 | Hermans | D21F 11/006 162/109 |
| 5,668,216 | A | 9/1997 | Kinkel et al. | |
| 5,886,121 | A | 3/1999 | Kinkel et al. | |
| 6,270,893 | B1 | 8/2001 | Young, Sr. et al. | |
| 6,593,408 | B1 | 7/2003 | Takaki et al. | |
| 9,215,941 | B1 | 12/2015 | Kressin | |
| 9,938,660 | B2 * | 4/2018 | Gomi | B27N 1/02 |
| 2003/0201051 | A1 | 10/2003 | Hansen et al. | |
| 2008/0179031 | A1 | 7/2008 | Tamai et al. | |
| 2009/0242154 | A1 * | 10/2009 | Beuther | B31F 1/126 162/111 |
| 2011/0247839 | A1 | 10/2011 | Lalouch et al. | |
| 2014/0027075 | A1 | 1/2014 | Yamagami et al. | |
| 2014/0345882 | A1 | 11/2014 | Lalouch et al. | |
| 2014/0374047 | A1 | 12/2014 | Yamagami | |
| 2016/0010278 | A1 | 1/2016 | Yamagami et al. | |
| 2016/0333521 | A1 * | 11/2016 | Gomi | B27N 1/02 |
| 2018/0080176 | A1 * | 3/2018 | Higuchi | B27N 3/04 |
| 2018/0169892 | A1 * | 6/2018 | Ueno | B27N 3/04 |

FOREIGN PATENT DOCUMENTS

| | | | |
|---|---|---|---|
| EP | 1570976 | A1 | 9/2005 |
| EP | 2664708 | A1 | 11/2013 |
| JP | 04-504287 | A | 7/1992 |
| JP | 08-503255 | A | 4/1996 |
| JP | 08-120551 | A | 5/1996 |
| JP | 2007-113010 | A | 5/2007 |
| JP | 2008-184700 | A | 8/2008 |
| JP | 2012-144819 | A | 8/2012 |

* cited by examiner

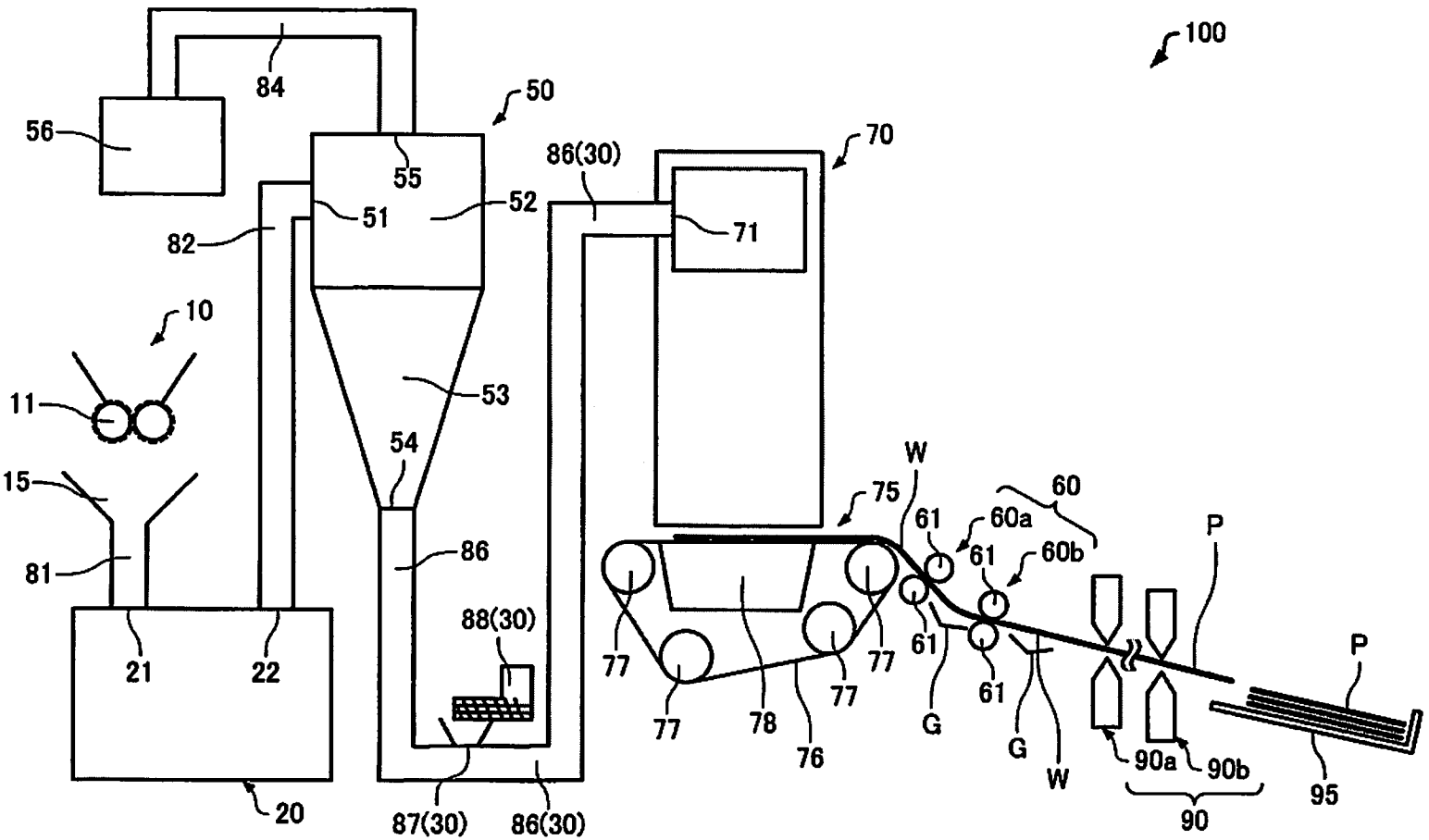
100
P
95
P
90b
90
90a
60
60b
60a
61
61
61
61
W
G
G
W
75
77
77
76
78
77
77
70
71
86(30)
86(30)
50
52
53
86
88(30)
87(30)
55
54
51
84
22
20
82
10
21
56
11
15
81

SHEET MANUFACTURING APPARATUS

This application is a 371 of PCT/JP2015/002058 filed 13 Apr. 2015

TECHNICAL FIELD

The present invention relates to a sheet manufacturing apparatus.

BACKGROUND

For centuries, sheets and films have been formed by depositing fibrous material and forming bonds between the deposited fibers. One typical example uses water to make paper in a pulp slurry (screening) method. The same basic pulp slurry method is still widely used to make paper today. Paper made by the pulp slurry method generally causes cellulose fibers derived from wood, for example, to interlock and then bonds fibers together using a binder (strengthening agent (such as starch glue, water-based resin)).

Due to environmental concerns and the demand for effective use of resources, many efforts have been made to recycle recovered paper. For example, PTL 1 describes a relatively small-scale paper manufacturing apparatus for making recycled paper from a slurry of recovered paper pulp. This apparatus creates a suspension of recovered paper pulp in water, screens the pulp suspension to form sheets, and then dries the sheets to produce recycled paper.

CITATION LIST

Patent Literature

[PTL 1] JP-A-2008-184700

SUMMARY OF INVENTION

Technical Problem

When sheets such as recycled paper are made using such slurry methods, the water must be evaporated to dry the sheets after screening the paper. Heat for evaporating the water is supplied by an electric heater, for example. With a paper manufacturing apparatus of a size suitable for use in an office environment such as described in PTL 1, selecting an energy source other than electricity for generating heat is typically not possible because connecting to utilities other than electric and water is difficult.

While the paper manufacturing apparatus described in PTL 1 removes some of the water by means of a squeeze roller before heating and drying, a large amount of water must still be made to evaporate. Furthermore, if the grammage (weight per unit area) of the manufactured paper is increased, the amount of water that must be evaporated also increases. A large amount of heat (energy) is required to evaporate water, an extremely large amount of energy is consumed to produce the heat, and this power accounts for a large portion of the total power consumption of the paper manufacturing apparatus.

One of the several objectives of the invention is to provide a sheet manufacturing apparatus that can manufacture sheets using a small amount of energy even when making high grammage sheets.

Solution to Problem

The present invention is directed to solving at least part of the foregoing problem, and can be achieved by the embodiments or examples described below.

A sheet manufacturing apparatus according to one aspect of the invention is characterized by supplying 0.014 times or more and 0.28 times or less energy to heat and compress a laid web of fiber and resin, bond multiple fibers through the resin, and form a sheet with grammage of 80 g/m$^2$ than the energy consumed to dry a web containing approximately the same weight percent of water as fiber and form a sheet with grammage of 80 g/m$^2$.

Even when forming sheets with high grammage of 80 g/m$^2$ or more, the sheet manufacturing apparatus of the invention can form sheets using significantly less energy than when configurations that form sheets through a slurry process using water.

A sheet manufacturing apparatus according to another aspect of the invention is characterized by the energy supplied to heat and compress a laid web of fiber and resin, bond multiple fibers through the resin, and form a sheet with grammage of 80 g/m$^2$ is greater than or equal to 174 J and less than or equal to 3600 J per one A4 size sheet This sheet manufacturing apparatus can form sheets with grammage of 80 g/m$^2$ or more using an extremely small amount of energy.

In another aspect of the invention, water is not added to the fiber before heating and compressing the web, and the energy is greater than or equal to 174 J and less than or equal to 2600 J.

This sheet manufacturing apparatus does not require heat to evaporate water, and can manufacture sheets with extremely low energy consumption.

In a sheet manufacturing apparatus according to another aspect of the invention, the moisture content of the fiber is adjusted before heating and compressing the web, and the energy is greater than or equal to 174 J and less than or equal to 3600 J.

Even if water is added to adjust the moisture content, this sheet manufacturing apparatus can manufacture sheets with extremely low energy consumption.

A sheet manufacturing apparatus according to another aspect of the invention may use a heat roller to heat the web.

This sheet manufacturing apparatus can apply heat to a concentrated portion of the web. As a result, energy consumption can be reduced compared with a configuration that heat a broad area such as when heating the web by means of a flat press or hot air.

BRIEF DESCRIPTION OF DRAWINGS

FIG. 1 illustrates a sheet manufacturing apparatus according to an embodiment of the invention.

DESCRIPTION OF EMBODIMENTS

Preferred embodiments of the invention are described below. The embodiments described below describe exemplary embodiments of the invention. The invention is not limited to the following examples, and includes variations thereof not departing from the scope of the accompanying claims. Note that all of the configurations described below are not necessarily configurations essential to the invention.

1. Sheet Manufacturing Apparatus

A sheet manufacturing apparatus according to this embodiment of the invention has at least a configuration for forming an air-laid web, and a configuration for heating and compressing the web. Broadly speaking, air laying refers to a method of forming a web using the flow of air. More specifically, air laying refers to conveying feedstock (containing fiber and resin) using air as the conveyance medium, and depositing the feedstock on mesh, for example. FIG. 1 illustrates a sheet manufacturing apparatus 100 as an example of a sheet manufacturing apparatus according to this embodiment.

A detangler 70 and a sheet-forming unit 75 embody the air laying configuration of the paper manufacturing apparatus 100. The paper manufacturing apparatus 100 uses a heating unit 60 as the configuration for heating and compressing the web and binding the fibers with resin.

1.1. Detangler

The sheet manufacturing apparatus 100 has a detangler 70. In the sheet manufacturing apparatus 100 shown in FIG. 1, the detangler 70 and sheet-forming unit 75 are disposed downstream from the mixing unit 30. A suction mechanism 78 is also disposed to the sheet-forming unit 75.

A mixture of fiber and resin that past through the conduit 86 (mixing unit 30) is introduced from the inlet 71 to the detangler 70, which disperses the mixture in air while it precipitates. The sheet manufacturing apparatus 100 also has a sheet-forming unit 75, and the sheet-forming unit 75 forms the mixture precipitating from the detangler 70 into an air-laid web W. The mixture of fiber and resin passes through the detangler 70 and is deposited on the sheet-forming unit 75.

The detangler 70 can detangle interlocked fibers. The detangler 70 also works to lay the mixture uniformly on the sheet-forming unit 75 described below. More specifically, "detangle" as used here includes comminuting interlocked material and laying a uniform web. Note that if there is no interlocked material, the detangler 70 has the effect of laying a uniform web.

A sieve (sifter) is used as the detangler 70. One example of a detangler 70 is a rotary sieve that can be turned by a motor. The sieve of the detangler 70 does not need to function to select specific material. More specifically, the "sieve" used as the detangler 70 means a device having mesh (filter, screen), and the detangler 70 may cause the entire mixture of fiber and resin introduced to the detangler 70 to precipitate through the sieve. The fiber and resin may also be mixed in detangler 70.

1.2. Sheet Forming Unit

The sheet manufacturing apparatus 100 has a sheet-forming unit 75. The mixture of fiber and resin that past through the detangler 70 is deposited on the sheet-forming unit 75. As shown in FIG. 1, the sheet-forming unit 75 has a mesh belt 76, tension rollers 77, and suction mechanism 78. The sheet-forming unit 75 may also be configured with a tension roller and take-up roller not shown.

The sheet-forming unit 75 forms a web W of the mixture precipitating through air from the detangler 70 (equivalent to a web forming process in conjunction with the detangler 70). The sheet-forming unit 75 functions to lay the mixture uniformly distributed in air by the detangler 70 on the mesh belt 76.

An endless mesh belt 76 with mesh formed therein and tensioned by the tension rollers 77 (four tension rollers 77 in this embodiment) is disposed below the detangler 70. The mesh belt 76 moves in one direction by rotation of at least one of the tension rollers 77.

Directly below the detangler 70 is a suction mechanism 78 as a suction unit that produces a downward air flow through the mesh belt 76. The mixture dispersed in air by the detangler 70 can be pulled onto the mesh belt 76 by the suction mechanism 78. As a result, the mixture suspended in air can be suctioned, and the discharge rate from the detangler 70 can be increased. As a result, the productivity of the sheet manufacturing apparatus 100 can be increased. The suction mechanism 78 can create a downward air flow in the descent path of the mixture, and can prevent the defibrated material and functional material from becoming interlocked during descent.

A continuous web W with the mixture deposited in a uniform layer can then be formed by causing the mixture to precipitate from the detangler 70 while moving the mesh belt 76. "Laid uniformly" means the deposited material is laid in substantially the same thickness and substantially the same density. However, because not all of the precipitate is necessarily formed into a sheet, it is sufficient for the portion that becomes a sheet to be uniform. "Laid unevenly" means not laid uniformly.

Note that the mesh belt 76 may be made of metal, plastic, cloth, or nonwoven cloth, and may be configured in any way enabling laying fibers and air to pass through. The mesh (diameter) of the mesh belt 76 is, for example, greater than or equal to 60 μm and less than or equal to 250 μm. If the mesh is less than 60 μm, it is difficult for the suction device 78 to maintain a stable air flow. If the hole size of the mesh belt 76 is greater than 250 μm, fibers in the mixture may enter the mesh and the size of irregularities in the surface of the formed sheet may increase. The suction device 78 can be constructed by forming an air-tight box with a window of a desirable size below the mesh belt 76, and pulling air in through the window so that the pressure inside the box is lower than the outside pressure.

As described above, a fluffy web W containing much air is formed by passing through the detangler 70 and sheet-forming unit 75 (web forming process). Next, as shown in FIG. 1, the web W laid on the mesh belt 76 is conveyed by the rotating movement of the mesh belt 76. A web W is thus formed as described above.

The web W formed on the mesh belt 76 in the sheet manufacturing apparatus 100 according to this embodiment is then conveyed to the heating unit 60. Because the web W contains resin, fibers are bonded by applying heat, and the web W can be manufactured as a nonwoven cloth or other type of sheet S.

The thickness of the formed web W is not specifically limited, and the web W can be formed to a specific thickness by adjusting the speed at which the sieve of the detangler 70 turns, the suction rate of the suction mechanism 78 of the sheet-forming unit 75, or the conveyance speed of the mesh belt 76, for example. The grammage of the web W can be adjusted in the same way.

Grammage is the weight per unit area of the web W or sheet S, and is normally expressed in $g/m^2$ units. The volume of the web W may be made smaller (compressed) in the heating unit 60 described below, but because the weight does not change, the grammage of the web W is substantially identical to the grammage of the sheet S. Therefore, the grammage of the sheet S manufactured by the sheet manufacturing apparatus 100 is adjusted primarily by the detangler 70 and the sheet-forming unit 75.

1.3. Heating Unit

The sheet manufacturing apparatus 100 according to this embodiment has a heating unit 60. The heating unit 60 is disposed downstream from the sheet-forming unit 75. The heating unit 60 heats the web W formed in the sheet-forming unit 75 so that the resin bonds fibers in the web W together. The heating unit 60 may also have the ability to form the mixture into a specific shape.

The heating unit 60 has the ability to mold the mixed fiber (defibrated material) and resin, that is, the mixture, into a specific form. The fiber and resin thus bond in the molding (sheet) of the fiber and resin formed in the heating unit 60.

In addition to applying heat to the mixture, the heating unit 60 may also apply pressure, and in this case the heating unit 60 has the ability to mold the mixture into a specific shape. The amount of pressure applied is appropriately adjusted according to the type of sheet to be formed, and can be greater than or equal to 100 kPa and less than or equal to 1 MPa. Paper with a high porosity can be made if the applied pressure is low, and paper with low porosity (high density) can be made if the applied pressure is high. When the mixture is laid as a web, the web may be compressed to 1/5 to 1/100 of the air-laid thickness, and porosity may be adjusted by controlling the degree of compression.

The heating unit 60 binds multiple fibers in the mixture together through the resin by applying heat to the mixture of fiber and resin. When the resin is a thermoplastic resin, the resin softens or melts when heated to the glass transition temperature (softening point) or a temperature near or exceeding the melting point (in the case of a crystalline polymer), and hardens when the temperature drops. The resin can be softened to interlock with the fibers, and the fiber and resin can then be bonded together by the resin hardening. Fibers can also be bonded by other fibers bonding when the resin hardens. If the resin is a thermoset resin, fiber and resin can be bonded by heating the resin to a temperature greater than or equal to the softening point, or heating to or above the curing temperature (the temperature at which the curing reaction occurs). Note that the melting point, softening point, and curing temperature of the resin, for example, are preferably lower than the melting point, decomposition temperature, and carbonization temperature of the fiber, and both types of materials are preferably combined to achieve this relationship. Note that the resin may remain without melting or flowing in the heating unit 60.

The specific configuration of the heating unit 60 may include, for example, a heat roller (heater roller), hot press molding machine, hot plate, heat blower, infrared heater, or flash fuser. In the sheet manufacturing apparatus 100 according to the embodiment shown in FIG. 1, the heating unit 60 is configured with a heat roller 61. By heating the web W, fibers in the web W can be made to bind together through the resin. By using a heat rollers 61 as shown in the FIGURE in the heating unit 60, heat can be concentrated to a narrower area of the web W than in a configuration using a hot press molding machine, heat blower, or infrared heater. As a result, energy consumption can be reduced compared with a configuration that heats a wide area by means of a hot press or hot air.

In the example shown in the FIGURE, the heating unit 60 is configured to heat and compress the web W held between rollers, and has a pair of heat rollers 61. When the heating unit 60 is configured with a flat press, a buffer unit (not shown in the FIGURE) must be provided to pause the web while the press is applied to the web. Compared with using a flat press as the heating unit 60, however, sheets can be formed while continuously conveying the web W by configuring the heating unit 60 with a heat roller 61.

The heating unit 60 of the sheet manufacturing apparatus 100 according to this embodiment has a first heat unit 60*a* located on the upstream side in the conveyance direction of the web W, and a second heat unit 60*b* located downstream from the first heat unit 60*a*, and the first heat unit 60*a* and second heat unit 60*b* each have a pair of heat rollers 61. A guide G that assists conveying the web W is also located between the first heat unit 60*a* and second heat unit 60*b*.

The heat roller 61 is a hollow cored bar of aluminum, iron, or stainless steel, for example. On the surface of the heat roller 61 is a tube made of PFA (tetrafluoroethylene-perfluoroalkylvinylether copolymer) or PTFE (polytetrafluoroethylene), or a release layer made of PTFE or other fluororesin coating. Note that a silicon rubber, urethane rubber, cotton, or other type of elastic layer may be disposed between the cored bar and the release layer. By providing an elastic layer, the heat roller 61 pair can contact the web uniformly along the axis of the heat rollers 61 when the pair of heat rollers 61 applies a heavy load.

A halogen heater or other type of heating member is disposed as the heating means inside the cored bar. The temperature of the heat rollers 61 and heating member are acquired by a temperature detection means not shown, and driving the heating member is control led based on the acquired temperature. As a result, the surface temperature of the heat rollers 61 can be maintained at a specific temperature. By passing the web W between the heat rollers 61, the conveyed web W can be heated and compressed. Note that the heating means is not limited to a halogen heater, and a heating means that uses a non-contact heater, or a heating means that uses hot air, may be used.

The heating unit 60 shown in the FIGURE has two sets of heat roller 61 pairs as an example, but when heat rollers 61 are used in the heating unit 60, the number and locations of the heat rollers 61 are not specifically limited and may be desirably configured to achieve the foregoing operation. The configuration (release layer, elastic layer, thickness and material of the cored bar, outside diameter of the roller) of the heat rollers 61 in each heating unit 60, and the pressure applied by the heat rollers 61, may also differ in each heating unit 60.

When resin is contained in the functional material, the resin melts when passing through the heating unit 60 (heat process), interlocks more easily with the fibers in the defibrated material and binds the fibers, and a sheet S according to this embodiment of the invention is made.

The amount of heat (energy) applied to the web W by the heating unit 60 only needs to be enough for the resin to bind the fibers sufficiently to achieve the strength required in the manufactured sheet S. More specifically, applying enough heat (energy) to melt or soften at least part of the resin in the web W is sufficient. Enough heat (energy) to melt or soften all of the resin in the web W may also be applied.

If the resin is polyester, which is a crystalline polymer, the heat of fusion is approximately 140 J/g. The weight of a single A4-size sheet of a web W with a grammage of 80 g/m$^2$ is approximately 4.97 g. If the content (described below) of resin (polyester) to web W is 25 wt %, the amount of polyester contained in one A4-size sheet of the web W is approximately 1.24 g. Approximately 174 J of heat (energy) applied to the A4-size web W is therefore sufficient to produce an A4-size sheet S.

If the web is formed in a wet process (screening using water), for example, if the web is formed by screening a slurry of pulp in suspension, the web will contain approximately the same amount of water as fiber (water equal to 100 wt % of the fiber content) even if water is mechanically squeezed from the web. This means that an A4-size sheet of an 80 g/m$^2$ web W will contain approximately 5 g or more of water. The web W must then be heated by heat rollers, for example, to evaporate the water and dry the sheet. Even if the temperature of the water is 30° C. before heat is applied, approximately 1470 J is required to heat 5 g of water to 100° C., and approximately 11,250 J of heat (energy) for the water to evaporate. A total of approximately 12,720 J of heat (energy) must therefore be supplied to every A4-size section of the web W. Because power consumption is thus high, the operating cost of the sheet manufacturing apparatus also increases.

The amount of energy applied to an 80 g/m$^2$ web W by the heating unit 60 of the sheet manufacturing apparatus 100 in this embodiment of the invention is therefore approximately (174/12,720=) 0.014 times the amount of energy consumed to dry a web containing approximately the same amount or more of water as fiber (water equal to 100 wt % of the fiber content) and produce a sheet with grammage of 80 g/m$^2$ or more.

Note that this example assumes the web W is compressed to achieve approximately equal amounts of fiber and water, but if dewatering is more insufficient, energy consumption may be even less than the 0.014 times noted above.

Furthermore, while this example uses polyester as the resin, even other types of resin (including amorphous resin) do not have a heat of fusion (including the energy required for glass-elastomer transition, or the energy required for softening) of 15 times or more per gram. The resin load (to the web W) in this example is 25 wt %, but even if the ratio of resin to fiber is increased (to 100 wt %, for example), the required heat energy is less than or equal to approximately 15 times. Therefore, the amount of heat (energy) applied (introduced) to an 14-size section of web W by the heating unit 60 is at most approximately 2600 J.

Therefore, even if other types of resin are used or the resin load is increased, the amount of energy introduced to a web W with grammage of 80 g/m$^2$ or greater by the heating unit 60 of the sheet manufacturing apparatus 100 according to this embodiment is approximately (2600/12,720=) 0.20 times the energy consumed to dry a web containing approximately equal weights of fiber and water and produce a sheet of 80 g/m$^2$. Note that while the thermal conductivity of the web W is not considered in this example, thermal conductivity is likely lower when compressed in a dry state than a wet state, and the approximately 0.20 times cited above may be exceeded.

Water may also be added to the web W by a moisture content control mechanism not shown disposed before the heating unit 60. However, because this increases the amount of energy applied to the web W by the heating unit 60, the amount of moisture added using this mechanism is controlled so that the required energy per one A4-size section of web W is greater than or equal to 174 J and less than or equal to 3600 J. As a result, the energy supplied by the heating unit 60 to an 80 g/m$^2$ or greater web W is greater than or equal to 0.014 and less than or equal to (3600/12,720=) 0.28 times the energy consumed to dry a web containing approximately equal weight percents of fiber and water and produce an 80 g/m$^2$ sheet. Note that the moisture content of the web W after adjusting the moisture content is here assumed to be 8% of the weight of the web W.

However, the sheet manufacturing apparatus 100 according to this embodiment preferably does not use such a moisture content adjustment mechanism and preferably does not add water to the fiber before heating and compressing the web W in the heating unit 60. This configuration does not need to consume energy to evaporate moisture, and can manufacture sheets S while consuming a very small amount of energy.

Herein, "bind (bond) fiber and resin" refers to states in which separation of the fibers and resin is difficult, and separation of fibers from other fibers is made difficult by the resin. Bind also includes the concept of adhesion, and includes states in which two or more objects are touching and difficult to separate. In addition, when fibers are bonded through a composite, the fibers may be mutually parallel or intersecting, and multiple fibers may be bonded to a single fiber.

1.4. Other Configurations

In addition to the detangler, sheet forming unit, and heating unit described above, the sheet manufacturing apparatus 100 according to this embodiment may also have other configurations such as a shredder, defibrating unit, classifier, mixing unit, calender, separator, or cutting unit. Multiple detanglers, sheet forming units, heat units, shredders, defibrating units, classifiers, mixing units, calenders, separators, or cutting units may also be provided as needed.

1.4.1. Defibrating Unit

The sheet manufacturing apparatus 100 may also have a defibrating unit 20. Fiber is introduced to the detangler 70, and the fiber may be supplied to the detangler 70 by the defibrating unit 20. Other configurations may also be disposed between the defibrating unit 20 and the detangler 70. Other configurations may also be disposed upstream from the defibrating unit 20.

The defibrating unit 20 defibrates the feedstock to be defibrated. By defibrating the feedstock, the defibrating unit 20 produces defibrated material that is separated into fibers. The defibrated material contains fiber, and the defibrating unit 20 may be configured to supply the fiber to the detangler 70 described above. The defibrating unit 20 also functions to separate particulate such as resin, ink, toner, and sizing agents adhering to the feedstock from the fibers.

The defibration process is a process of separating feedstock material comprising bonded fibers into individual fibers. Material that has past through the defibrating unit 20 is referred to as defibrated material. In addition to separated fibers, the defibrated material may also contain resin particles (resin used to bind multiple fibers together), ink particles such as ink or toner and sizing agents, that are separated from the fibers when the fibers are detangled. The detangled defibrated material is string- or ribbon-shaped. The detangled defibrated material may have the fibers not interlocked with (be separate from) other detangled fibers, or may be interlocked in clumps with other detangled defibrated material (forming fiber clumps). The defibrated material is the fiber that is one component of the sheet S.

In the sheet manufacturing apparatus described herein, terms such as upstream and downstream are used in reference to the flow (including the conceptual flow) of the material in the manufactured sheet (including raw materials, feedstock, defibrated material (fiber), and web). The terms upstream side (and downstream side) are used to identify the relative positions of components such that, for example, "A is on the upstream side (downstream side) of B" means that the location of A relative to the location of B is upstream (downstream) in the direction of the flow of the paper material.

The defibrating unit 20 may be any configuration with the ability to defibrate the feedstock. The defibrating unit 20 defibrates in air (air) in a dry defibration process. In the example shown in the FIGURES, the feedstock introduced from the inlet port 21 is defibrated by the defibrating unit 20, becoming defibrated material (fiber); and the defibrated material discharged from the outlet port 22 is then supplied to the detangler 70 through a conduit 82, classifier 50, and another conduit 86.

A dry process as used herein means processing in air (air) and not liquid. "Dry" as used herein includes a dry state, and states in which liquid is present as an impurity and liquid was intentionally added. Note that when liquid is not added intentionally, the energy introduced (applied) to the web W by the heating unit 60 is less than or equal to approximately 2600 J per one A4-size section of a web W with grammage of 80 g/m$^2$ or more. If water is added to the web W by a moisture content adjustment mechanism before the web W reaches the heating unit 60, the energy supplied (applied) is less than or equal to approximately 3600 J per one A4-size section of a web W with grammage of 80 g/m$^2$ or more.

The configuration of the defibrating unit 20 is not specifically limited, and in one example has a rotary unit (rotor) and a stationary unit covering the rotary unit with a space (gap) between the rotary unit and the stationary unit. When the defibrating unit 20 is thus comprised, defibration occurs when the feedstock is introduced to this gap while the rotary unit is turning. In this event, the speed and shape of the rotary unit, and the shape of the stationary unit, can be designed appropriately to the properties of the sheet to be made and the requirements of the overall device configuration. The rotational speed (revolutions per minute (rpm)) of the rotary unit can be set appropriately with consideration for the throughput of the defibration process, the retention time of the feedstock, the degree of defibration, the size of the gap, and the shape, size, and other factors of the rotary unit, stationary unit, and other members.

Note that the defibrating unit 20 further preferably has means for producing an air current to suction the feedstock and/or discharge the defibrated material. In this event, the air flow produced by the defibrating unit 20 pulls the feedstock in with the air flow from the inlet port 21, the feedstock is defibrated, and the defibrated material is conveyed to the outlet port 22. If a defibrating unit 20 without a blower mechanism is used, a mechanism may alternatively be externally disposed to produce an air flow carrying the feedstock to the inlet port 21 and an air flow that discharges the defibrated material from the outlet port 22.

1.4.1.1 Feedstock

The feedstock as used herein refers to objects containing the material to be processed by the sheet manufacturing apparatus 100, including pulp sheets, paper, used paper, tissue paper, kitchen paper, cleaning paper, filter paper, liquid absorption materials, sound absorption materials, cushioning materials, mats, cardboard, and other products comprising interlocked or bonded fibers. Note that herein the feedstock may also be sheets that are manufactured by the sheet manufacturing apparatus 100, and sheets that have been used (recovered sheets). Fibers (organic fiber, inorganic fiber, and blends of organic and inorganic fibers) made of rayon, Lyocell, cupro, Vinylon, acrylic, nylon, aramid, polyester, polyethylene, polypropylene, polyurethane, polyimide, carbon, glass, or metal may also be contained in the feedstock. When the classifier 50 described be low is also included in the sheet manufacturing apparatus 100 according to this embodiment, recovered paper and recovered sheets in particular can be effectively used as the feedstock.

1.4.1.2 Defibrated Material

In the sheet manufacturing apparatus 100 according to this embodiment, the defibrated material is used as part of the material in the sheets that are manufactured. The defibrated material includes the fiber acquired by defibrating the feedstock described above, and examples of such fiber include natural fiber (animal fiber, plant fiber) and synthetic fiber (organic fiber, inorganic fiber, and blends of organic and inorganic fibers). Yet more specifically, fibers derived from cellulose, silk, wool, cotton, true hemp, kenaf, flax, ramie, jute, manila, sisal, evergreen trees, and deciduous trees may be contained in the defibrated material, the fibers may be used alone, mixed with other fibers, or refined or otherwise processed as regenerated fiber. The defibrated material is the material from which is paper is then made, and may include only one type of fiber. The defibrated material (fiber) may also be dried, or it may contain or be impregnated with water, organic solvent, or other liquid. Various types of surface processing may also be applied to the defibrated material (fiber).

The average diameter (the diameter of the circle (circle-equivalent diameter) assuming a circle with the same area as the area in cross section, or the maximum length in the direction perpendicular to the length when not round in section) of the single independent fibers contained in the defibrated material used in this embodiment of the invention is on average greater than or equal to 1 μm and less than or equal to 1000 μm, preferably greater than or equal to 2 μm and less than or equal to 500 μm, and further preferably greater than or equal to 3 μm and less than or equal to 300 μm.

The length of the fibers contained in the defibrated material used in this embodiment is not specifically limited, but the length of single independent fibers along the length of the fiber is preferably greater than or equal to 1 μm and less than or equal to 5 mm, is further preferably greater than or equal to 2 μm and less than or equal to 3 mm, and is yet further preferably greater than or equal to 3 μm and less than or equal to 2 mm. When the fiber length is short, the strength of the paper may be insufficient because bonding with resin is difficult. Expressed as the length-length-weighted mean length, the average fiber length is preferably greater than or equal to 2 μm and less than or equal to 3600 μm, is further preferably greater than or equal to 200 μm and less than or equal to 2700 μm, and is yet further preferably greater than or equal to 300 μm and less than or equal to 2300 μm. The fiber length may also have some variation (distribution).

"Fiber" as used herein may refer to a single fiber or an agglomeration of multiple fibers (such as cotton); and defibrated material refers to material containing multiple fibers, and includes both the meaning of an agglomeration of fibers and the meaning of materials (powder or fiber objects) used to make the sheets.

The defibrated material that past the defibrating unit 20 is mixed with resin before it is formed into sheets. Any desirable method of mixing may be used, but mixing is simplified by using the mixing unit 30 described below.

1.4.2. Classifier

The sheet manufacturing apparatus 100 may also have a classifier 50. In the sheet manufacturing apparatus 100 shown in FIG. 1, the classifier 50 is located upstream from the detangler 70 and downstream from the defibrating unit 20. The classifier 50 separates and removes resin particles and ink particles from the defibrated material. As a result, the percentage of fiber in the defibrated material can be increased. The classifier 50 is preferably an air classifier. An air classifier is a device that produces a helical air flow, and separates by size and density material that is classified by centrifugal force, and the cut point can be adjusted by adjusting the speed of the air flow and the centrifugal force. More specifically, a cyclone, elbow-jet or eddy classifier, for example, may be used as the classifier 50. A cyclone is particularly well suited as the classifier 50 because of its simple construction. A cyclone is used as the classifier 50 in this example.

The classifier 50 has an inlet 51, a cylinder 52 connected to the inlet 51, an inverted conical section 53 located below the cylinder 52 and connected continuously to the cylinder 52, a bottom discharge port 54 disposed in the bottom center of the conical section 53, and a top discharge port 55 disposed in the top center of the cylinder 52.

In the classifier 50, the air flow carrying the defibrated material introduced from the inlet 51 changes to a circular air flow in the cylinder 52, which has an outside diameter of 100 mm or more and 300 mm or less. As a result, the defibrated material that is introduced can be separated by centrifugal force into the fibers of the defibrated material and fine particles such as resin particles and ink particles in the defibrated material. The high fiber content portion is discharged from the bottom discharge port 54 and introduced to the conduit 86. Fine particles are discharged to the outside of the classifier 50 from the top discharge port 55 through a conduit 84. In the example shown in the FIGURE, the conduit 84 is connected to a receiver 56, and the fine particles are collected in the receiver 56. Because the classifier 50 discharges fine particles including resin particles and ink particles to the outside, the amount of resin relative to the defibrated material can be prevented from becoming excessive even when resin is later added on the downstream side.

Note that while the classifier 50 is described as separating fiber and particulate, they cannot be separated completely. For example, relatively small and relatively low density fiber may be discharged together with the fine particulate. Relatively high density particles and particles interlocked with fiber may also be discharged downstream with the fiber.

When the feedstock is pulp sheet instead of recovered paper or recovered sheets, the classifier 50 may be omitted from the sheet manufacturing apparatus 100 because fine particles such as resin particles and ink particles are not present. Conversely, the sheet manufacturing apparatus 100 is preferably configured with a classifier 50 when the feedstock is recovered paper or recovered sheets in order to improve the color of the sheets that are made.

1.4.3. Mixing Unit

The sheet manufacturing apparatus 100 according to this embodiment may also have a mixing unit 30. A mixture of fiber and resin is introduced to the detangler 70 described above, but the fiber and resin may also be mixed in the detangler 70. However, a mixing unit 30 may also be provided to mix the fiber and resin and supply the mixture to the detangler 70. In this embodiment, mixing fiber and resin means placing resin between individual fibers within a space (channel) of a constant volume.

The mixing unit 30 has the function of mixing fiber (fiber material) in the defibrated material that past the defibrating unit 20 with resin. The mixing unit 30 may also intermix components other than fiber and resin. The resin may also be a composite with other components. A "composite" as used herein means a particle formed by integrating the resin as the main component with another component. The other component refers to an anti-blocking agent or coloring agent, for example, and may differ from the main resin component in shape, size, material, and function.

Insofar as the mixing unit 30 mixes the fiber (fibrous material) and resin, the mixing unit 30 is not specifically limited to any specific configuration, structure, or mechanisms, for example. In addition, the mixing process of the mixing unit 30 may be run as a batch operation (batch process), a serial process, or a continuous process. The mixing unit 30 may also be operated manually or automatically. Yet further, the mixing unit 30 mixes at least fiber and resin, but may also intermix other components.

Examples of the mixing process of the mixing unit 30 include mechanical mixing and mixing by means of fluid dynamics. Examples of mechanical mixing include methods of introducing fiber (defibrated material) and composite to a Henschel mixer for stirring, and methods of enclosing the fiber and composite in a bag and shaking the bag. A process for mixing by means of fluid dynamics may, for example, load the fiber (defibrated material) and resin into a current of air, for example, and disperse the fiber and resin in air. In this method of introducing fiber and resin to an air current, the resin may be injected to a conduit through which the fiber is carried (transported) by the air flow, or the fiber may be injected to a conduit through which the resin is carried (transported) by the air flow. Note that in this event, a turbulent air flow through the conduit mixes more efficiently and is therefore preferable.

When a mixing unit 30 is disposed to the sheet manufacturing apparatus 100, the mixing unit 30 is located downstream of the defibrating unit 20 and upstream of the configuration whereby the defibrated material is bonded by the resin in the direction of the flow of (part of) the feedstock in the sheet manufacturing apparatus 100. Other configurations may be disposed between the mixing unit 30 and defibrating unit 20. The mixture that was mixed by the mixing unit 30 (referred to below as simply the mixture) may be further mixed by the detangler 70 or other configuration.

When a conduit 86 used for conveying the fiber is used as the mixing unit 30 as shown in FIG. 1, resin may be introduced while the fiber is conveyed by the flow of air, for example. A blower not shown is one example of a means of generating a flow of air when a conduit 86 is used as the mixing unit 30, and the blower may be disposed as needed to achieve this function.

Introduction of the resin when a conduit 86 is used for the mixing unit 30 could be done by opening and closing a valve or manually by the operator, but a screw feeder such as shown in FIG. 1 or a disc feeder not shown, for example, may also be used as the resin supply unit 88. Using such a feeder is preferable because variation in the amount (added amount) of the resin in the direction of the air flow can be reduced. This also applies when the resin is conveyed by air and the fiber (defibrated material) is added to the air flow.

In the sheet manufacturing apparatus 100 according to this embodiment the mixing unit 30 is preferably a dry process unit. As used here, dry mixing means mixing in air (air), not water. In other words, the mixing unit 30 may operate in a dry state, or it may operate in the presence of liquid as an impurity or the presence of liquid that is added intentionally. When liquid is added intentionally, the liquid is preferably added to the extent that the energy and time required to remove the liquid by heating, for example, in a later process is not too great.

Insofar as the fiber (defibrated material) and resin can be mixed, the processing capacity of the mixing unit 30 is not specifically limited and can be desirably designed and adjusted according to the production capacity (throughput) of the sheet manufacturing apparatus 100. If operating in a batch process mode, the processing capacity of the mixing unit 30 may be adjusted by changing the size of the processing vessel or the size of the load; and when a conduit 86 is used, the processing capacity may be adjusted by changing the amount of air carrying the fiber and resin through the conduit 86, the amount of material that is loaded, or the conveyance capacity, for example.

The resin supply unit 88 supplies resin in air from the supply inlet 87 to the conduit 86. More specifically, the resin supply unit 88 supplies resin to the path through which the defibrated material flows (in the example in the FIGURE, between the classifier 50 and the detangler 70). The configuration of the resin supply unit 88 is not specifically limited insofar as it can supply the composite to the conduit 86, and may be a screw feeder or a circle feeder. A mixture is formed as a result of the fiber and resin passing through the conduit 86. Therefore, the mixing unit 30 in the sheet manufacturing apparatus 100 according to this embodiment is configured to include the resin supply unit 88 and the conduit 86. Note that because the mixture may be further mixed in the detangler 70 described below, the detangler 70 may also be considered a mixing unit 30.

1.4.4. Resin

The type of resin that is mixed with the fiber may be a natural resin or a synthetic resin, and may be a thermoplastic resin or a thermoset resin, but when using a sheet S manufactured by the sheet manufacturing apparatus 100 according to this embodiment as the feedstock, acquiring fiber from the sheet S, and manufacturing a sheet S (where the sheet S may also be a sheet according to this embodiment) containing said fiber and resin (functional material), that is, when manufacturing a recycled sheet, using a thermoplastic resin is preferable. This is because when resin is used to bind fibers together, it is difficult to create sufficient bond strength again in the recycled sheet using a thermoset resin. When resin is used as a functional material in a sheet according to this embodiment and the resin binds fibers together, the resin is preferably solid at room temperature and thermoplastic resin is preferable for binding fibers together by applying heat.

The resin is supplied from the resin supply unit 88 in the sheet manufacturing apparatus 100 according to this embodiment. Examples of natural resins include rosin, dammar, mastic, copal, amber, shellac, Dragon's blood, sandarac, and colophonium, which may be used individually or in appropriate mixtures, and may be appropriately denatured.

Examples of synthetic resins that are thermoset resin include thermosetting resins such as phenol resin, epoxy resin, melamine resin, urea resin, unsaturated polyester resin, alkyd resin, polyurethane, and thermoset polyimide resin.

Examples of synthetic resins that are thermoplastic resin include AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone.

The resins may be used individually or in combination. The resins may also be copolymerized or modified, examples of such resins including styrene-based resin, acrylic-based resin, styrene-acrylic copolymers, olefin-based resin, vinyl chloride-based resin, polyester-based resin, polyamide-based resin, polyurethane-based resin, polyvinyl alcohol-based resin, vinyl ether-based resin, N-vinyl-based resin, and styrene-butadiene-based resin.

The resin may be fibrous or powder. If the resin is fibrous, the fiber length of the resin is preferably less than or equal to the fiber length of the defibrated material. More specifically, the fiber length of the resin is preferably less than or equal to 3 mm, and further preferably less than or equal to 2 mm. If the fiber length of the resin is greater than 3 mm, mixing the resin uniformly with the defibrated material may be difficult. If the resin is a powder, the particle size (diameter) of the resin is greater than or equal to 1 μm and less than or equal to 50 μm, and is more preferably greater than or equal to 2 μm and less than or equal to 20 μm. If the particle size of the resin is less than 1 μm, the cohesive force bonding the fibers of the defibrated material may drop. If the particle size of the resin is greater than 20 μm, mixing the resin uniformly with the defibrated material may be more difficult, adhesion with the defibrated material drops and the resin may separate from the defibrated material, and irregularities may result in the manufactured sheet.

The fiber (fiber material) and resin (composite) are mixed in the mixing unit 30, and the mixture ratio of these components can be adjusted according to the desired strength and use of the manufactured sheet. If the manufactured sheet is copy paper for office use, for example, the ratio of resin to fiber is preferably greater than or equal to 5 wt % and less than or equal to 70 wt %, and is further preferably greater than or equal to 5 wt % and less than or equal to 60 wt % considering better mixing in the mixing unit 30 and to reduce the effect of gravity when the mixture is formed into a sheet.

The amount of resin supplied from the resin supply unit 88 is set appropriately to the type of sheet being manufactured. In the example in the FIGURE, the supplied resin is mixed with the defibrated material in the conduit 86 embodying the mixing unit 30. Note that the resin may be used as an additive in combination with other components. Examples of such other components include anti-blocking agents, coloring agents, organic solvents, surfactants, fungicides, preservatives, anti-oxidants, ultraviolet absorber, and oxygen absorbers. Anti-blocking agents and coloring agents are described more specifically below.

1.4.1.1. Anti-Blocking Agents

The resin may be in the form of an additive containing an anti-blocking agent to suppress the agglomeration of fibers in the defibrated material and the agglomeration of resin particles. When an anti-blocking agent is included in the resin, the resin and anti-blocking agent are preferably integrated. More specifically, to include the anti-blocking agent in the resin, the resin is preferably an integrated composite of the resin and the anti-blocking agent.

A "composite" as used herein means a particle formed by integrating the resin as one component with another component. The other component refers to an anti-blocking agent or coloring agent, for example, and may differ from the main resin component in shape, size, material, and function.

When an anti-blocking agent is mixed in the resin, the composite particles integrating resin with the anti-blocking agent are more resistant to blocking than when the anti-blocking agent is not included. Various types of anti-blocking agents may be used, but because the sheet manufacturing apparatus 100 according to this embodiment uses no or little water, the anti-blocking agent is preferably imparted to the surface of the composite particles (and may be a coating (covering)).

One example of an anti-blocking agent is a fine particulate of inorganic material, which by being disposed to the surface of the composite achieves a particularly outstanding anti-blocking effect. Agglomeration refers to objects of the same or dissimilar types being held in physical contact by electrostatic force or van der Waals' forces. In addition, there being no blocking in an agglomeration of multiple particles (such as a powder) does not necessarily mean that all particles in the agglomeration are discretely dispersed. More specifically, no blocking includes blocking of some of particles in the agglomeration, and even if the amount of blocked particles is less than or equal to 10 wt %, and preferably less than or equal to 5 wt %, of the total agglomeration, this state is included in there being no blocking in the agglomeration of multiple particles. Furthermore, when powder is packed in a bag, the particles of the powder will be in contact, but if the particles can be separated by applying an external force that is not sufficient to crush the particles, such as by gentle stirring, dispersion by air, or a free fall, this is also considered as there being no blocking.

Specific examples of materials that may be used as an anti-blocking agent include silica, titanium oxide, aluminum oxide, zinc oxide, cerium oxide, magnesium oxide, zirconium oxide, strontium titanate, barium titanate, and calcium carbonate. Some materials that can be used as an anti-blocking agent (such as titanium oxide) may also be used as coloring agents, but differ in that the particle diameter of the anti-blocking agent is smaller than the particle diameter of the coloring agent. As a result, the anti-blocking agent does not greatly affect the color of the manufactured sheet, and can be differentiated from the coloring agent. However, even if the particle size of the anti-blocking agent is small, the anti-blocking agent may have a slight effect on the scattering of light, and this effect is preferably considered when adjusting the color of the sheet.

The mean particle size (number average particle size) of the particles in the anti-blocking agent is not specifically limited, but is preferably 0.001-1 μm, and more preferably 0.008-0.6 μm. Because particles of the anti-blocking agent are very small, near the range of nanoparticles, they are generally primary particles. However, plural primary particles in an anti-blocking agent may combine to form high order particles. If the particle size of the primary particles is within the range described above, the surface of the particles can be desirably coated, giving the composite a sufficient anti-blocking effect. Particles of a composite having an anti-blocking agent disposed to the surface of the resin (particles) have an anti-blocking agent between one composite particle and another composite particle, and clumping thereof is suppressed. Note that if the resin and anti-blocking agent are discrete and not integrated, anti-blocking agent will not necessarily always be between one resin particle and another resin particle, and the anti-blocking effect between resin particles is lower than when the anti-blocking agent and resin are integrated.

The amount of anti-blocking agent in a integrated composite of resin and anti-blocking agent is preferably greater than or equal to 0.1 parts by weight and less than or equal to 5 parts by weight relative to 100 parts by weight of the composite. The effect described above can be achieved with this content. Considering, for example, improving the foregoing effect and/or suppressing the loss of anti-blocking agent from the manufactured sheet S or web W, the content is further preferably greater than or equal to 0.2 parts by weight and less than or equal to 4 parts by weight, and yet further preferably greater than or equal to 0.5 parts by weight and less than or equal to 3 parts by weight, relative to 100 parts by weight of the composite.

When the anti-blocking agent is imparted to the surface of the resin, a good anti-blocking effect can be obtained if the ratio of the surface of the composite that is coated with anti-blocking agent (area ratio: also referred to herein as the coverage) is greater than or equal to 20% and less than or equal to 100%. The coverage can be adjusted by mixing in a device such as an FM Mixer. Furthermore, if the specific surface areas of the anti-blocking agent and resin are known, the coverage can be adjusted by controlling the mass (weight) of the components in the preparation. The coverage can also be measured by various types of electron microscopes. Note that if the anti-blocking agent is imparted to the composite in such a way that separation from the resin is difficult, the anti-blocking agent and resin may be said to be integrated.

Because blocking of composites can be made extremely difficult by including an anti-blocking agent in the composite, the resin (composite) and fiber (defibrated material) can be mixed even more easily in the mixing unit 30. More specifically, if an anti-blocking agent and resin are combined to form a composite, the composite can be quickly distributed in space, and a mixture with a more uniform distribution of the fiber and resin can be created than when an anti-blocking agent is not included.

1.4.4.2. Coloring Agent

The resin may also be an additive containing a coloring agent. When a coloring agent is included in the resin, the resin and coloring agent are preferably integrated. More specifically, when a coloring agent is included in the resin, the resin and the coloring agent preferably form a composite.

An integrated composite of resin and coloring agent means that the coloring agent is resistant to separation (resistant to loss) in the sheet manufacturing apparatus 100 and/or the manufactured sheet. In other words, an integrated composite of resin and coloring agent refers to the coloring agent being bonded with the resin, coloring agent being structurally (mechanically) affixed to resin, an agglomeration of resin and coloring agent through electrostatic force or van der Waals' forces, for example, or the resin and coloring agent being held together by a chemical bond. The composite integrating resin and coloring agent includes the coloring agent being enveloped by resin or the coloring agent adhering to the resin, or the coloring agent and resin existing in both states simultaneously.

Insofar as separation of the coloring agent from the resin is difficult during processing in the sheet manufacturing apparatus 100 and when the sheet is formed, the integrated composite of resin and coloring agent is not limited to the foregoing, and the coloring agent may be affixed to the surface of resin particles by electrostatic force or van der Waals' forces, for example, as long as separation of the coloring agent from the resin is difficult. Furthermore, various combinations of the plural forms described above by example can be used insofar as separation of the coloring agent from the composite is difficult.

Note that the preferred disposition of the coloring agent in the composite is conceptually the same as the disposition of the anti-blocking agent in the composite described in section 1.4.4.1 Anti-blocking agent. However, it is important to note that the anti-blocking agent has a smaller particle size than the coloring agent.

The coloring agent functions to impart a specific color to the sheet manufactured by the sheet manufacturing apparatus 100 in this embodiment of the invention. The coloring agent may be a dye or pigment, and when integrated with resin in a composite, a pigment is preferably used because better opacity and chromogenicity can be achieved.

The color and type of pigment is not specifically limited, and pigments of the colors (such as white, blue, red, yellow, cyan, magenta, yellow, black, and special colors (pearl, metallic luster)) used in common ink can be used. The pigment may be an inorganic pigment or an organic pigment. Pigments known from the literature, such as described in JP-A-2012-87309 and JP-A-2004-250559 can be used as pigment. White pigments such as zinc oxide, titanium oxide, antimony trioxide, zinc sulfide, clay, silica, white carbon, talc, and alumina white may also be used. The pigments may be used individually or desirably mixed. Note that when a white pigment is chosen from among the above examples, using a pigment comprising a powder containing particles (pigment particles) of which titanium oxide is the main component is preferable because the high refractive index of titanium oxide enables easily increasing the whiteness of the manufactured sheet with a small amount of pigment.

1.4.5. Shredder

The sheet manufacturing apparatus may also include a shredder. The sheet manufacturing apparatus 100 shown in FIG. 1 has a shredder 10 on the upstream side of the defibrating unit 20. The shredder 10 shreds feedstock such as pulp sheet and recovered sheet material (such as A4 size used paper) in air, and supplies shredded feedstock of a desirable size to the defibrating unit 20. While the shape and size of the shreds are not specifically limited, the shreds are preferably a few centimeters square. In the example in the FIGURE, the shredder 10 has shredder blades 11, and shreds the supplied feedstock by the shredder blades 11. An automatic feeder (not shown in the FIGURE) for continuously feeding feedstock may also be disposed to the shredder 10.

A specific example of the shredder 10 is a paper shredder. In the example in the FIGURE, the sheets shredded by the shredder 10 are received by a hopper 15 and conveyed as the feedstock to be defibrated to the defibrating unit 20 through a conduit 81. The conduit 81 connects to the inlet port 21 of the defibrating unit 20.

1.4.6. Separator

While not shown in the FIGURES, the sheet manufacturing apparatus according to this embodiment may also have a separator. The separator can select fibers of a particular length from the defibrated material processed by the defibrating unit 20. Therefore, the separator is disposed downstream from the defibrating unit 20 and upstream from the mixing unit 30.

A sieve (sifter) can be used as the separator. The separator has mesh (filter, screen), and separates material of a size that can pass through the mesh from material of a size that cannot pass through. The separator can be configured similarly to the detangler 70 described above, but functions to remove some of the material instead of passing all introduced material like the detangler 70. One example of a separator is a rotary sieve that can be turned by a motor. The mesh of the separator may be a metal screen, expanded metal made by expanding a metal sheet with slits formed therein, or punched metal having holes formed by a press in a metal sheet.

By using a separator, fiber or particles contained in the defibrated material or mixture that are smaller than the size of the mesh can be separated from fiber, undefibrated paper particles, and clumps that are larger than the size of the mesh. The separated materials can also be used selectively according to the sheet being made. Material that is removed by the separator may be returned to the defibrating unit 20.

1.4.7. Compression Unit

The sheet manufacturing apparatus 100 in this embodiment may also have a compression unit. The compression unit may be located downstream from the mixing unit 30 and upstream from the heating unit 60. The compression unit may compress the web W that past the sheet-forming unit 75 and was formed into a sheet without heating the web W. The compression unit therefore does not have a heater or other heating means. The compression unit is more specifically configured to apply a calendering process.

As a result of the compression unit applying pressure to (compressing) the web W, the gaps (distance) between fibers in the web W are reduced and the density of the web W can be increased. The compression unit can be configured to hold and compress the web W between rollers, and a configuration having a pair of calender rolls can be used.

Because the compression unit applies pressure without applying heat, the resin does not melt when resin is contained in the functional material. When resin is not contained in the functional material, the compression unit functions to increase the density of the web W. The web W is compressed and the gaps (distance) between fibers in the web W are reduced in the compression unit. In other words, a web W with increased density is formed. The pressure applied by the compression unit is preferably set greater than the pressure applied by the heating unit 60. For example, the pressure applied by the compression unit is preferably 500-3000 kgf, and the pressure applied by the heating unit 60 is 30-200 kgf. By setting the pressure of the compression unit greater than the heating unit 60, the distance between fibers in the web W can be sufficiently shortened by the compression unit, and by then applying heat and pressure, thin, high density, high strength sheets S can be made.

The diameter of the calender rollers may be greater than the diameter of the heat rollers 61. In other words, the diameter of the calender rolls disposed on the upstream side in the conveyance direction of the web W is greater than the diameter of the heat rollers 61 on the downstream side. Because the diameter of the calender rolls is greater, the uncompressed web W can be gripped and efficiently conveyed. Because the web W that past the calender rolls is compressed and easy to convey, the diameter of the heat rollers 61 downstream from the calender rolls may be small. As a result, the device configuration can be made smaller. Note that the diameters of the heat rollers 61 and calender rolls are set appropriately to the thickness, for example, of the web W being manufactured.

1.4.8 Cutter Unit

The sheet manufacturing apparatus may also have a cutter unit 90. As shown in FIG. 1, the sheet manufacturing apparatus 100 according to this embodiment has a first cutter unit **90*a* and a second cutter unit 90*b* as a cutter unit 90 that cuts the sheets transversely to the conveyance direction of the web W (sheet S) downstream from the heating unit 60. The cutter unit 90 can be disposed as required. The first cutter unit 90*a* has a cutter, and cuts the continuous sheet into single leaves at a cutting position set to a specific length. The second cutter unit 90*b* that cuts the sheet S along the conveyance direction of the sheet S is disposed downstream from the first cutter unit 90*a* in the conveyance direction of the sheet S. The second cutting unit 90*b* has a cutter, and cuts (severs) at a specific cutting position in the conveyance direction of the sheet S. As a result, paper of a desired size is formed. The cut sheet S is then stacked in a stacker 95**, for example.

1.5. Operating Effect

A sheet manufacturing apparatus 100 according to this embodiment of the invention can make sheets with a grammage of 80 g/m$^2$ or more using very little energy compared with a configuration that forms sheets with a grammage of 80 g/m$^2$ or more in a slurry process using water. More specifically, the energy applied by the heating unit 60 of the sheet manufacturing apparatus 100 according to this embodiment to the web W to form sheets with grammage of 80 g/m$^2$ or greater is greater than or equal to 0.014 and less than or equal to 0.28 times the energy consumed to dry a web containing approximately the same weight percent of water as fiber and produce a sheet with grammage of 80 g/m$^2$ or more. The amount of energy supplied can therefore be reduced. As a result, costs associated with the sheet manufacturing apparatus may also drop. Fibers can also be bonded using resin. Note that the energy supplied to form a sheet with grammage of 80 g/m$^2$ or more is the same as the energy required to form a sheet with grammage of 80 g/m$^2$ or more.

2. Additional Notes

"Uniform" as used herein means, in the case of a uniform dispersion or mixture, that the relative positions of one component to another component in an object that can be defined by components of two or more types or two or more phases are the same throughout the whole system, or equal or effectively equal in each part of a system. Words meaning uniform, same, equidistant and similar terms meaning that density, distance, dimensions, and similar terms are equal are used herein. These are preferably equal, but include values deviating without being equal by the accumulation of error, deviation, and such because complete equality is difficult.

The present invention is not limited to the embodiment described above, and can be varied in many ways. For example, the invention includes configurations (configurations of the same function, method, and effect, or configurations of the same objective and effect) that are effectively the same as configurations described in the foregoing embodiment. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

REFERENCE SIGNS LIST

10 shredder
11 shredder blades
15 hopper
20 defibrating unit
21 inlet port
22 discharge port
30 mixing unit
50 classifier
51 inlet port
52 cylinder
53 conical section
54 bottom discharge port
55 top discharge port
56 receiver
60 heating unit
60*a* first heat unit
60*b* second heat unit
61 heat roller
70 detangler
71 inlet port
75 sheet forming unit
76 mesh belt
77 tension roller
78 suction mechanism
81, 82, 84, 86 conduit
87 supply port
88 resin supply unit
90 cutter unit
90*a* first cutter unit
90*b* second cutter unit
95 stacker
100 sheet manufacturing apparatus
G guide
W web
S sheet

The invention claimed is:

1. A sheet manufacturing apparatus, comprising:

a resin supply unit that supplies resin to a plurality of fibers;

a heating unit that supplies heat energy that is greater than or equal to 174 J and less than or equal to 3600 J per one A4 size sheet to a laid web of the fibers and the resin, to heat the laid web to melt or soften at least a part of the resin in the laid web, bond the fibers through at least the part of the resin, and form a sheet with grammage of 80 g/m$^{20}$ or more; and a compression unit that is arranged upstream relative to the heating unit in a conveyance direction of the laid web and compresses the laid web of the fibers and the resin.

2. The sheet manufacturing apparatus described in claim 1, wherein the heating unit that supplies the heat energy greater than or equal to 174 J and less than or equal to 2600 J to the laid web to which water is not added before the heating unit heats the web.

3. The sheet manufacturing apparatus described in claim 1, further comprising a moisture content control mechanism arranged upstream in a conveyance direction of the web relative to the heating unit, wherein the moisture content control mechanism adjusts moisture content of the fibers before the heating unit heats the web, and wherein the heating unit supplies the heat energy greater than or equal to 174 J and less than or equal to 3600 J.

* * * * *